US009374864B2

(12) United States Patent
Kamoi et al.

(10) Patent No.: US 9,374,864 B2
(45) Date of Patent: Jun. 21, 2016

(54) LIGHTING DEVICE AND LIGHT FIXTURE

(71) Applicant: Panasonic Intellectual Property Management Co., Ltd., Osaka (JP)

(72) Inventors: Takeshi Kamoi, Kyoto (JP); Akinori Hiramatu, Nara (JP); Hiroshi Kido, Osaka (JP); Katsushi Seki, Shiga (JP); Shigeru Ido, Osaka (JP); Daisuke Yamahara, Osaka (JP); Daisuke Ueda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/734,566

(22) Filed: Jun. 9, 2015

(65) Prior Publication Data

US 2016/0029444 A1 Jan. 28, 2016

(30) Foreign Application Priority Data

Jul. 24, 2014 (JP) ..... 2014-150947

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.

CPC ..... *H05B 33/083* (2013.01)

(58) Field of Classification Search

None

See application file for complete search history.

(56) References Cited

U.S. PATENT DOCUMENTS

| | | | | |
|---|---|---|---|---|
| 8,896,235 | B1 * | 11/2014 | Shum et al. | 315/309 |
| 2011/0227489 | A1 | 9/2011 | Huynh | |
| 2012/0098458 | A1 | 4/2012 | Dai et al. | |
| 2013/0026930 | A1 | 1/2013 | Ko | |
| 2013/0293122 | A1 | 11/2013 | Huynh | |
| 2014/0210362 | A1 * | 7/2014 | Shin et al. | 315/186 |

FOREIGN PATENT DOCUMENTS

| | | | |
|---|---|---|---|
| JP | 2002-158376 | A | 5/2002 |
| JP | 2009-230973 | A | 10/2009 |
| JP | 4581646 | B | 11/2010 |
| JP | 2011-198739 | A | 10/2011 |
| JP | 2012-94866 | A | 5/2012 |
| JP | 2013-30726 | A | 2/2013 |

* cited by examiner

*Primary Examiner* — Ahn Tran

(74) *Attorney, Agent, or Firm* — Renner, Otto, Boisselle & Sklar, LLP

(57) ABSTRACT

A controller circuit is configured to adjust the number of light-emitting diodes that a current flows from a rectifier circuit through so that: the number of light-emitting diodes, which are lit, of the plurality of light-emitting diodes increases according to a value of a pulsating voltage during a time period that the value of the pulsating voltage increases; and the number of light-emitting diodes, which are lit, of the plurality of light-emitting diodes decreases according to the value of the pulsating voltage during a time period that the value of the pulsating voltage decreases. Light-emitting diodes, which start to emit light by a higher voltage value, of the plurality of light-emitting diodes are disposed at a position nearer to an outside of a mounting region of a substrate than light-emitting diodes, which start to emit light by a lower voltage value, of the plurality of light-emitting diodes.

5 Claims, 9 Drawing Sheets

LIGHTING DEVICE AND LIGHT FIXTURE

CROSS REFERENCE TO RELATED APPLICATIONS

This application claims the benefit and priority of Japanese Patent Application No. 2014-150947, filed on Jul. 24, 2014, the entire contents of which are incorporated herein by reference.

TECHNICAL FIELD

The invention relates generally to lighting devices and light fixtures and, more particularly, to a lighting device configured to light semiconductor light-emitting devices such as light-emitting diodes and a light fixture with the same.

BACKGROUND ART

A light-emitting diode lighting device for lighting light-emitting diodes that are connected in series has been proposed so far (see, e.g., JP Pat. No. 4581646 (hereinafter referred to as "Document 1")).

A light-emitting diode lighting device disclosed in Document 1 includes a rectifier circuit, a light-emitting diode circuit and a lighting control circuit. The rectifier circuit is configured to full-wave rectify an AC voltage from an AC power supply, and a pulsating voltage obtained by full-wave rectification of the rectifier circuit is to be supplied to the light-emitting diode circuit. The light-emitting diode circuit is formed of a series circuit of a plurality of light-emitting diodes.

In the light-emitting diode lighting device, the plurality of light-emitting diodes are divided into a plurality of groups. The lighting control circuit performs lighting control of the plurality of light-emitting diodes so that (a) groups of which light-emitting diodes are lit more increase(s) as a value of the pulsating voltage from the rectifier circuit more increases. The lighting control circuit also performs lighting control of the plurality of light-emitting diodes so that (a) groups of which light-emitting diodes are lit more decrease(s) as the value of the pulsating voltage from the rectifier circuit more decreases.

In the light-emitting diode lighting device described in Document 1, the lighting control circuit is to increase or decrease the number of groups of which light-emitting diodes (semiconductor light-emitting devices) are lit in accordance with a value of the pulsating voltage from the rectifier circuit. The lighting control circuit therefore lights only light-emitting diodes in part of the plurality of groups and extinguishes (turns off) light-emitting diodes in remaining part of the plurality of groups when the value of the pulsating voltage is small.

In a case where the plurality of light-emitting diodes are mounted on a surface of a substrate, it is considered that light-emitting diodes in an identical group would be mounted together. Only light-emitting diodes in part of the plurality of groups are lit when the value of the pulsating voltage is small. In this case, if the light-emitting diodes in part of the plurality of groups are unevenly mounted on a corner of a mounting region of the substrate, unevenness may occur in a light output from the mounting region (i.e., a light output from a surface light source), where the mounting region is a region of the substrate, on which the plurality of light-emitting diodes are mounted. In a case where the plurality of light-emitting diodes are mounted so that light-emitting diodes of each group are evenly arranged on the mounting region of the substrate, the light-emitting diodes constituting the plurality of groups are mixed. In this case, wiring for connecting among light-emitting diodes in an identical group may become complicated.

SUMMARY OF THE INVENTION

The present invention has been achieved in view of the above circumstances, and an object thereof is to provide a lighting device capable of suppressing unevenness of a light output from a mounting region of a substrate without complicating wiring for electrically connecting among a plurality of semiconductor light-emitting devices on the mounting region, and a light fixture with the same.

According to an aspect of the invention, a lighting device includes a rectifier, a substrate, a plurality of semiconductor light-emitting devices and a controller. The rectifier is configured to rectify an AC voltage to produce a pulsating voltage. The plurality of semiconductor light-emitting devices is mounted on an identical surface of the substrate and electrically connected in series between first and second output terminals of the rectifier. The controller is configured to adjust a number of semiconductor light-emitting devices that a current flows from the rectifier through so that: a number of semiconductor light-emitting devices, which are lit, of the plurality of semiconductor light-emitting devices increases according to a value of the pulsating voltage during a time period that the value of the pulsating voltage increases; and the number of semiconductor light-emitting devices, which are lit, of the plurality of semiconductor light-emitting devices decreases according to the value of the pulsating voltage during a time period that the value of the pulsating voltage decreases. Semiconductor light-emitting devices, which start to emit light by a higher voltage value, of the plurality of semiconductor light-emitting devices are disposed at a position nearer to an outside of a mounting region of the substrate than semiconductor light-emitting devices, which start to emit light by a lower voltage value, of the plurality of semiconductor light-emitting devices. The mounting region is a region of the substrate, on which the plurality of semiconductor light-emitting devices is mounted.

According to an aspect of the invention, a light fixture includes the lighting device and a fixture body that holds the lighting device.

The lighting device and the light fixture can suppress the unevenness of the light output from the mounting region of the substrate without complicating wiring for electrically connecting among the plurality of semiconductor light-emitting devices on the mounting region.

BRIEF DESCRIPTION OF THE DRAWINGS

The figures depict one or more implementations in accordance with the present teaching, by way of example only, not bay way of limitations. In the figure, like reference numerals refer to the same or similar elements where.

DETAILED DESCRIPTION (Embodiment 1)

Figure 1:
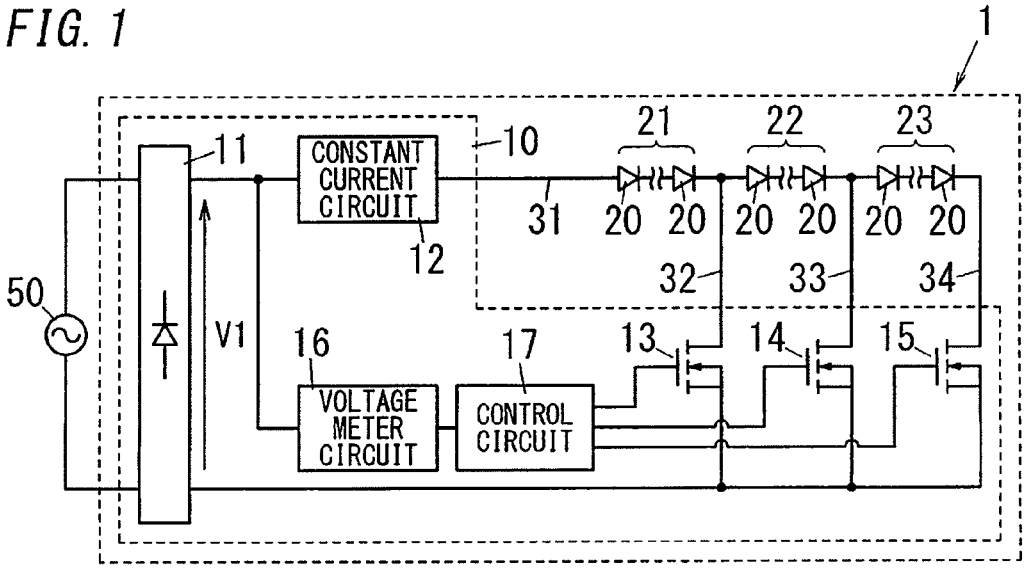
FIG. 1 is a circuit diagram of a lighting device in an embodiment 1.

A lighting device in accordance with an embodiment 1 of the present invention is explained with reference to FIGS. 1 to 6. FIG. 1 shows a circuit diagram of the lighting device in the embodiment.

The lighting device 1 in the embodiment includes a plurality of light-emitting diodes (LEDs) 20, and a lighting circuit 10 configured to light the plurality of light-emitting diodes 20. For example, the plurality of light-emitting diodes 20 is a plurality of white light emitting diodes.

The lighting circuit 10 includes a rectifier circuit 11 (a rectifier), a constant current circuit 12, a plurality of switch devices 13, 14 and 15, a voltage meter circuit (a voltage measuring circuit) 16 and a control circuit 17 (a controller).

The rectifier circuit 11 is configured to rectify an AC voltage from an AC power supply 50 to produce a pulsating voltage V1. For example, the rectifier circuit 11 is formed of a diode bridge circuit, and the AC power supply 50 is a commercial AC power supply or the like.

The plurality of light-emitting diodes 20 is electrically connected in series between first and second output terminals of the rectifier circuit 11. The plurality of light-emitting diodes 20 is divided into a plurality (three in the embodiment) of light-emitting device arrays 21, 22 and 23. Each of the plurality of light-emitting device arrays 21, 22 and 23 is formed of a series circuit of light-emitting diodes 20. In an example of FIG. 1, the first output terminal is a positive output terminal, and the second output terminal is a negative output terminal. Each of the plurality of light-emitting device arrays 21, 22 and 23 includes first and second electrodes (anode and cathode electrodes) electrically connected to sides of the first and second output terminals of the rectifier circuit 11, respectively.

The constant current circuit 12 is configured to adjust a (electric) current flowing through light-emitting diodes 20 to almost a constant current value. For example, the constant current circuit 12 is a constant current circuit with a transistor(s). In the example of FIG. 1, the constant current circuit 12 is electrically connected between the first output terminal of the rectifier circuit 11 and the plurality of light-emitting diodes 20 (the plurality of light-emitting device arrays 21, 22 and 23). However, the lighting circuit 10 may include a current-limiting circuit for limiting a current flowing through light-emitting diodes 20 to a prescribed limiting value or less instead of the constant current circuit 12. The current-limiting circuit includes a current-limiting resistor, for example.

The plurality of switch devices 13, 14 and 15 is electrically connected between the second electrodes (the cathode electrodes) of the plurality of light-emitting device arrays 21, 22 and 23 and the second output terminal of the rectifier circuit 11, respectively. The plurality of switch devices 13, 14 and 15 is configured to individually turn on and off in accordance with control signals which are input to the control electrodes (the gate electrodes) thereof from the control circuit 17, respectively. For example, each of the plurality of switch devices 13, 14 and 15 is a switch device such as a field-effect transistor. The number of the plurality of switch devices 13, 14 and 15 is the same as the number of the plurality of light-emitting device arrays 21, 22 and 23.

In the switch device 13, the first electrode (the drain electrode) is electrically connected to a junction between the light-emitting device arrays 21 and 22, and the second electrode (the source electrode) is electrically connected to the second output terminal of the rectifier circuit 11. The switch device 13 is configured to turn on and off in accordance with a control signal which is input to the control electrode (the gate electrode) thereof from the control circuit 17. If the switch device 13 is turned on with the switch devices 14 and 15 turned off, a current flows through the light-emitting device array 21, and all the light-emitting diodes 20 of the light-emitting device array 21 are lit. In this state, all the light-emitting diodes 20 of the light-emitting device arrays 22 and 23 are extinguished.

In the switch device 14, the first electrode (the drain electrode) is electrically connected to a junction between the light-emitting device array 22 and the light-emitting device array 23, and the second electrode (the source electrode) is electrically connected to the second output terminal of the rectifier circuit 11. The switch device 14 is configured to turn on and off in accordance with a control signal which is input to the control electrode (the gate electrode) thereof from the control circuit 17. If the switch device 14 is turned on with the switch devices 13 and 15 turned off, a current flows through the light-emitting device arrays 21 and 22, and all the light-emitting diodes 20 of the light-emitting device arrays 21 and 22 are lit. In this state, all the light-emitting diodes 20 of the light-emitting device array 23 are extinguished.

In the switch device 15, the first electrode (the drain electrode) is electrically connected to an opposite end of the light-emitting device array 23 from the light-emitting device array 22 (the cathode electrode of the light-emitting device array 23), and the second electrode (the source electrode) is electrically connected to the second output terminal of the rectifier circuit 11. The switch device 15 is configured to turn on and off in accordance with a control signal which is input to the control electrode (the gate electrode) thereof from the control circuit 17. If the switch device 15 is turned on with the switch devices 13 and 14 turned off, a current flows through all the plurality of light-emitting device arrays 21, 22 and 23, and all the light-emitting diodes 20 of the plurality of light-emitting device arrays 21, 22 and 23 are lit.

The voltage meter circuit 16 is configured to measure a value of the pulsating voltage V1 from the rectifier circuit 11 to supply a measurement result (the measured value) to the control circuit 17. In the example of FIG. 1, the voltage meter circuit 16 is electrically connected to the first output terminal of the rectifier circuit 11, and also electrically connected to the control circuit 17.

The control circuit 17 is, for example, a microcomputer, and includes prescribed functions realized by executing a program stored in a memory. In the embodiment, the control circuit 17 is configured to individually turn on and off the plurality of switch devices 13, 14 and 15 based on the value of the pulsating voltage V1 measured through the voltage meter circuit 16.

In the embodiment, a circuit for turning on and off the plurality of switch devices 13, 14 and 15 is formed of, but not limited to, the voltage meter circuit 16 and the control circuit 17. The circuit for turning on and off the plurality of switch devices 13, 14 and 15 in accordance with the value of the pulsating voltage V1 may be formed of an analog circuit.

A mounting form including the plurality of light-emitting diodes 20 is explained with reference to FIG. 2. The plurality of light-emitting diodes 20 is mounted on a surface of a substrate 30. The substrate 30 is a printed wiring board that is in the shape of a square in planar view. A mounting region 35 in the shape of a circle is provided on the surface of the substrate 30.

For example, each light-emitting diode 20 is of a surface mount type, and the plurality of light-emitting diode 20 is mounted on the substrate 30 to be disposed inside the mounting region 35. The embodiment increases or decreases the number of light-emitting diodes 20, which are lit, in accordance with the value of the pulsating voltage V1 from the rectifier circuit 11. As a result, a smoothing circuit for smoothing the pulsating voltage V1 is unnecessary, and the pulsating voltage V1 can be applied across light-emitting diodes 20 without the smoothing circuit. Therefore, a circuit configuration of the lighting circuit 10 can be made simple, and light-emitting diodes 20 can be lit efficiently. Since the circuit configuration of the lighting circuit 10 is simple, circuit components of the lighting circuit 10 can be mounted on the same surface as that on which the plurality of light-emitting diodes 20 is mounted as shown in FIG. 2, and the lighting device 1 can be miniaturized. In FIG. 2, an illustration of the circuit components of the lighting circuit 10 is omitted, and a region in which the circuit components of the lighting circuit 10 are mounted is shown by a surrounding dotted line (see the reference sign 10).

The plurality of light-emitting diodes 20 is electrically connected in series via conductive parts 36 formed of conductive metal films (e.g., copper foils) formed on the surface of the substrate 30. The plurality of light-emitting diodes 20 is mounted so as to be arranged along a single line corresponding to outer edges of three plus marks which are different in size. The light-emitting device array 21 is formed of light-emitting diodes 20 mounted along inside an outer edge of the innermost plus mark of the three plus marks. The light-emitting device array 22 is formed of light-emitting diodes 20 mounted along inside an outer edge of the middle plus mark of the three plus marks. The light-emitting device array 23 is formed of light-emitting diodes 20 mounted along inside an outer edge of the outermost plus mark of the three plus marks. Thus, since the plurality of light-emitting diodes 20 are arranged along the single line corresponding to the outer edges of the three plus marks, it is possible to electrically connect among the plurality of light-emitting diodes 20 by the conductive parts 36 formed on the surface of the substrate 30 without complicating wiring for the plurality of light-emitting diodes 20.

A first end of a circuit formed of the plurality of light-emitting diodes 20 in series (an end of the light-emitting device array 21) is electrically connected to an output terminal of the constant current circuit 12 via a conductive part 31. A second end of the circuit formed of the plurality of light-emitting diodes 20 in series (an end of the light-emitting device array 23) is electrically connected to the first electrode (the drain electrode) of the switch device 15 via a conductive part 34. The first electrode (the drain electrode) of the switch device 13 is electrically connected to the junction of the light-emitting device arrays 21 and 22 via a conductive part 32. The first electrode (the drain electrode) of the switch device 14 is electrically connected to the junction of the light-emitting device arrays 22 and 23 via a conductive part 33. The conductive parts 31 to 34 are formed of conductive metal films (e.g., copper foils) formed on the surface of the substrate 30 (see FIG. 2).

Figure 3:
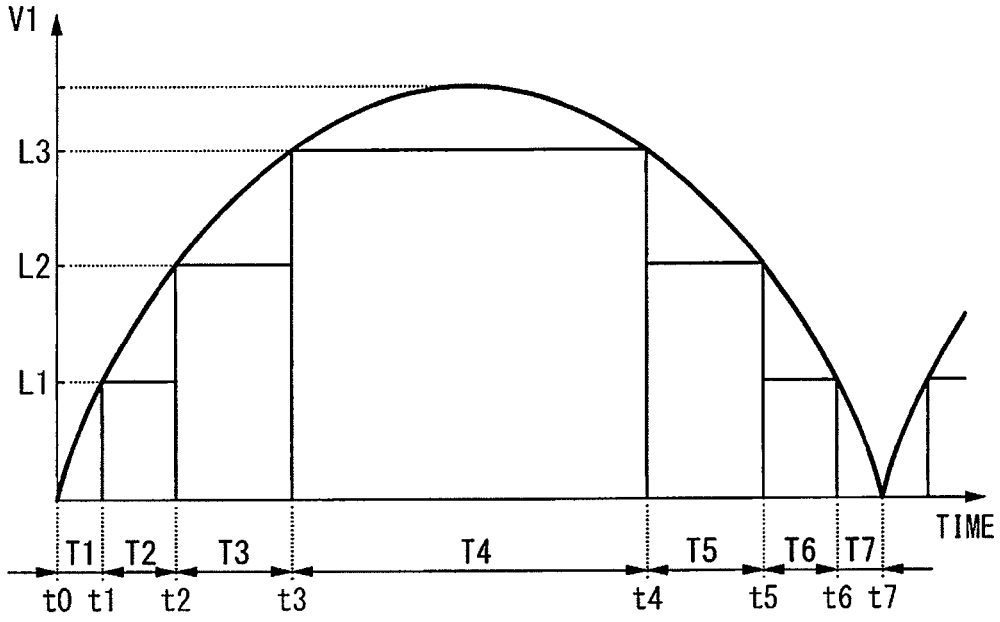
FIG. 3 is a waveform chart of an output voltage of a rectifier circuit which the lighting device in embodiment 1 includes.

A lighting operation of light-emitting diodes 20 lit by the lighting circuit 10 is explained with reference to FIG. 3. FIG. 3 is a waveform chart of the pulsating voltage V1 from the rectifier circuit 11.

The control circuit 17 sets each of the plurality of the switch devices 13, 14 and 15 to an OFF state during a time period that the pulsating voltage V1 is below a threshold voltage L1, e.g., about 40V (a time period T1 from a time point t0 to a time point t1, and a time period T7 from a time point t6 to a time point t7). In this case, all the light-emitting diodes 20 of the plurality of light-emitting device arrays 21, 22 and 23 are extinguished because no current flows through all the light-emitting diodes 20 of the plurality of light-emitting device arrays 21, 22 and 23. However, if the time periods T1 and T6 during each of which all diodes 20 are extinguished become longer within one period of the pulsating voltage V1, noticeable flicker is likely to occur. The threshold voltage L1 is therefore set so as to limit each of the time periods T1 and T6 to a time period for suppressing the noticeable flicker.

Figure 4:
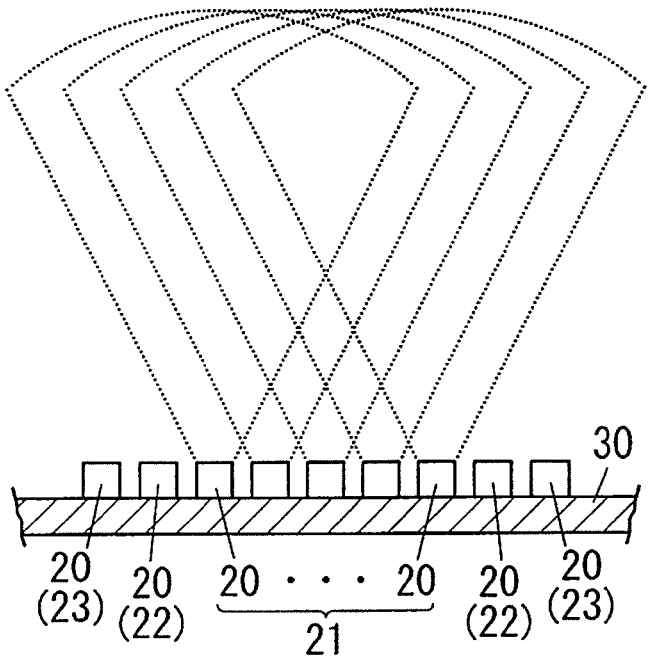
FIG. 4 is a sectional view taken along an A1-A2 line in FIG. 2 and shows a lighting state by the lighting device in embodiment 1.

The control circuit 17 sets the switch device 13 to an ON state and sets each of the switch devices 14 and 15 to an OFF state during a time period that the pulsating voltage V1 is the threshold voltage L1 or more and below a threshold voltage L2, e.g., about 80V (a time period T2 from the time point t1 to a time point t2 and a time period T6 from a time point t5 to the time point t6). In this case, a current flows through only all the light-emitting diodes 20 of the light-emitting device array 21, and no current flows through all the light-emitting diodes 20 of the light-emitting device arrays 22 and 23. This lighting state by the plurality of light-emitting device arrays 21, 22 and 23 is shown in FIG. 4 which is a sectional view taken along an A1-A2 line in FIG. 2. In the figure, dotted lines illustrate respective light emitted from the light-emitting diodes 20. During the time periods T2 and T6, the light-emitting diodes 20 of the light-emitting device array 21 arranged at an innermost position in the mounting region 35 are lit, and the light-emitting diodes 20 of the light-emitting device arrays 22 and 23 arranged outside the light-emitting device array 21 are extinguished.

Figure 5:
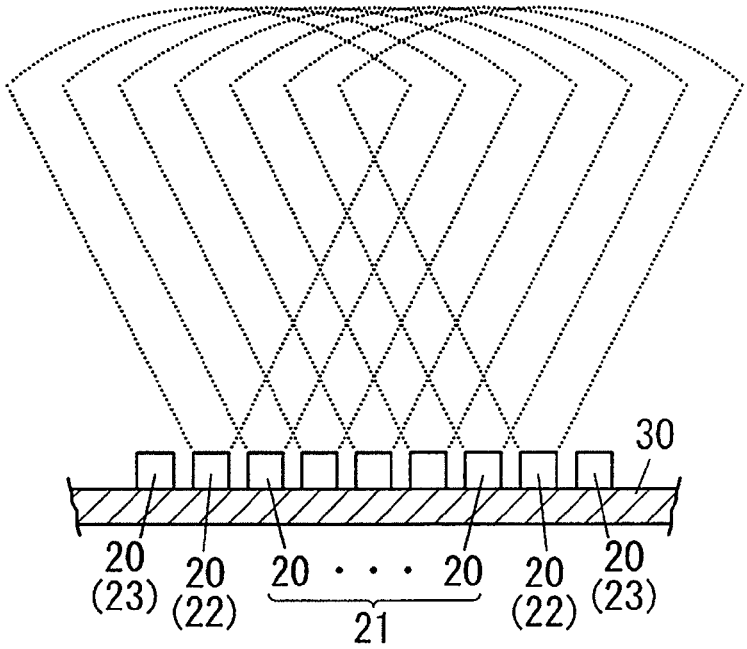
FIG. 5 is a sectional view taken along an A1-A2 line in FIG. 2 and shows a lighting state by the lighting device in embodiment 1.

The control circuit 17 sets the switch device 14 to an ON state and sets each of the switch devices 13 and 15 to an OFF state during a time period that the pulsating voltage V1 is the threshold voltage L2 or more and below a threshold voltage L3, e.g., about 120V (a time period T3 from the time point t2 to a time point t3 and a time period T5 from a time point t4 to the time point t5). In this case, a current flows through all the light-emitting diodes 20 of the light-emitting device arrays 21 and 22, and no current flows through all the light-emitting diodes 20 of the light-emitting device array 23. This lighting state by the plurality of light-emitting device arrays 21, 22 and 23 is shown in FIG. 5 which is the sectional view taken along the A1-A2 line in FIG. 2, and in which dotted lines illustrate respective light emitted from the light-emitting diodes 20 of the light-emitting device arrays 21 and 22. During the time periods T3 and T5, the light-emitting diodes 20 of the light-emitting device arrays 21 and 22 arranged at the innermost position and a middle position in the mounting region 35 are lit, and the light-emitting diodes 20 of the light-emitting device array 23 arranged at the outermost position therein are extinguished.

Figure 6:
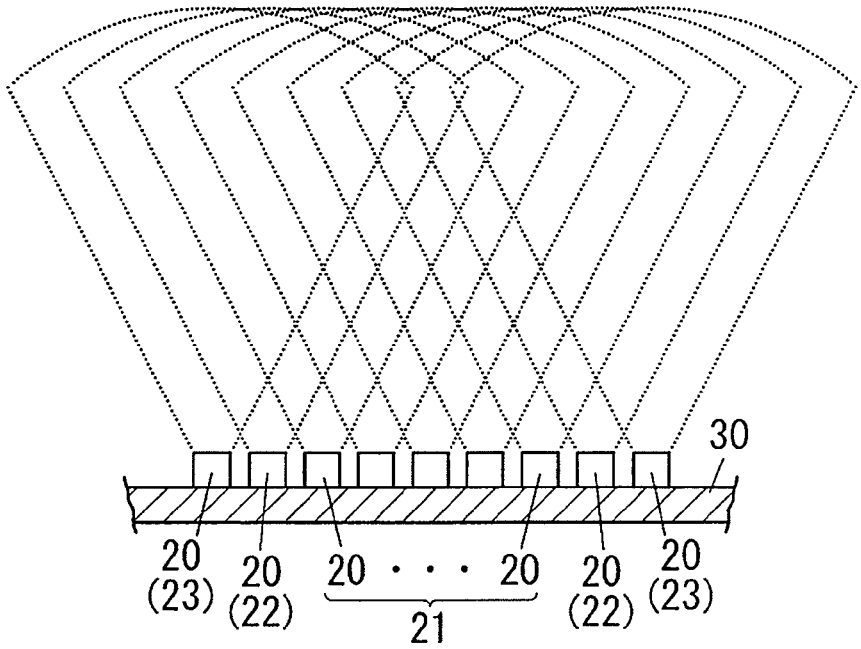
FIG. 6 is a sectional view taken along an A1-A2 line in FIG. 2 and shows a lighting state by the lighting device in embodiment 1.

The control circuit 17 sets the switch device 15 to an ON state and sets each of the switch devices 13 and 14 to an OFF state during a time period that the pulsating voltage V1 is the threshold voltage L3 or more (a time period T4 from the time point t3 to the time point t4). In this case, a current flows through all the light-emitting diodes 20 of the plurality of light-emitting device arrays 21, 22 and 23, and all the light-emitting diodes 20 of the plurality of light-emitting device arrays 21, 22 and 23 are lit. This lighting state by the plurality of light-emitting device arrays 21, 22 and 23 is shown in FIG. 6 which is the sectional view taken along the A1-A2 line in FIG. 2, and in which dotted lines illustrate respective light emitted from the light-emitting diodes 20 of the plurality of light-emitting device arrays 21, 22 and 23. During the time period T4, all the light-emitting diodes 20 of the plurality of light-emitting device arrays 21, 22 and 23 mounted on the mounting region 35 are lit.

As stated above, the control circuit 17 performs ON/OFF control of the plurality of switch devices 13, 14 and 15 to increase or decrease the number of light-emitting diodes 20, which are lit, in accordance with the value of the pulsating voltage V1.

In the embodiment, during a time period that the value of the pulsating voltage V1 increases (a half-cycle of the pulsating voltage V1), the control circuit 17 performs ON/OFF control of the plurality of switch devices 13, 14 and 15 so as to increase the number of light-emitting diodes 20, which are lit, in accordance with the value of the pulsating voltage V1. Thus, the lighting device 1 switches, in turns, the plurality of switch devices 13, 14 and 15 from a state of all the plurality of light-emitting diodes 20 being extinguished to a state of FIG. 4 in which only the light-emitting device array 21 is lit, a state of FIG. 5 in which the light-emitting device arrays 21 and 22 are lit, and a state of FIG. 6 in which all the plurality of light-emitting diodes 20 is lit.

During a time period that the value of the pulsating voltage V1 decreases (another half-cycle of the pulsating voltage V1), the control circuit 17 performs ON/OFF control of the plurality of switch devices 13, 14 and 15 so as to decrease the number of light-emitting diodes 20, which are lit, in accordance with the value of the pulsating voltage V 1. Thus, the lighting device 1 switches, in turns, the plurality of switch devices 13, 14 and 15 from the state of FIG. 6 in which all the plurality of light-emitting diodes 20 is lit to the state of FIG. 5 in which the light-emitting device arrays 21 and 22 are lit, the state of FIG. 4 in which only the light-emitting device array 21 is lit, and a state of all the plurality of light-emitting diodes 20 being extinguished.

During the time period that the value of the pulsating voltage V1 increases, the light-emitting device array 21 at the innermost position in the mounting region 35 is first lit, the light-emitting device array 22 outside the light-emitting device array 21 is then lit, and the light-emitting device array 23 outside the light-emitting device array 22 is finally lit. During the time period that the value of the pulsating voltage V1 decreases, the light-emitting device array 23 at the outermost position in the mounting region 35 is first extinguished, the light-emitting device array 22 inside the light-emitting device array 23 is then extinguished, and the light-emitting device array 21 inside the light-emitting device array 22 is finally extinguished. An operation, in which a range of light-emitting diodes 20 which are lit spreads from an inner side to an outer side in the mounting region 35 and then narrows from the outer side to the inner side in the mounting region 35, is repeated cyclically. Deviation of a light output from the mounting region 35 (i.e., a light output from a surface light source) can be prevented and unevenness of the light output can be reduced. The light-emitting device array 21 arranged at the innermost position in the mounting region 35 is lit for the longest time within one cycle of the pulsating voltage V1, and accordingly quantity of light around a center of the mounting region 35 can be increased. Therefore, light control can be made easy in a case where the lighting device 1 is embedded into a light fixture configured to give light to a specified object like a spotlight.

Figure 2:
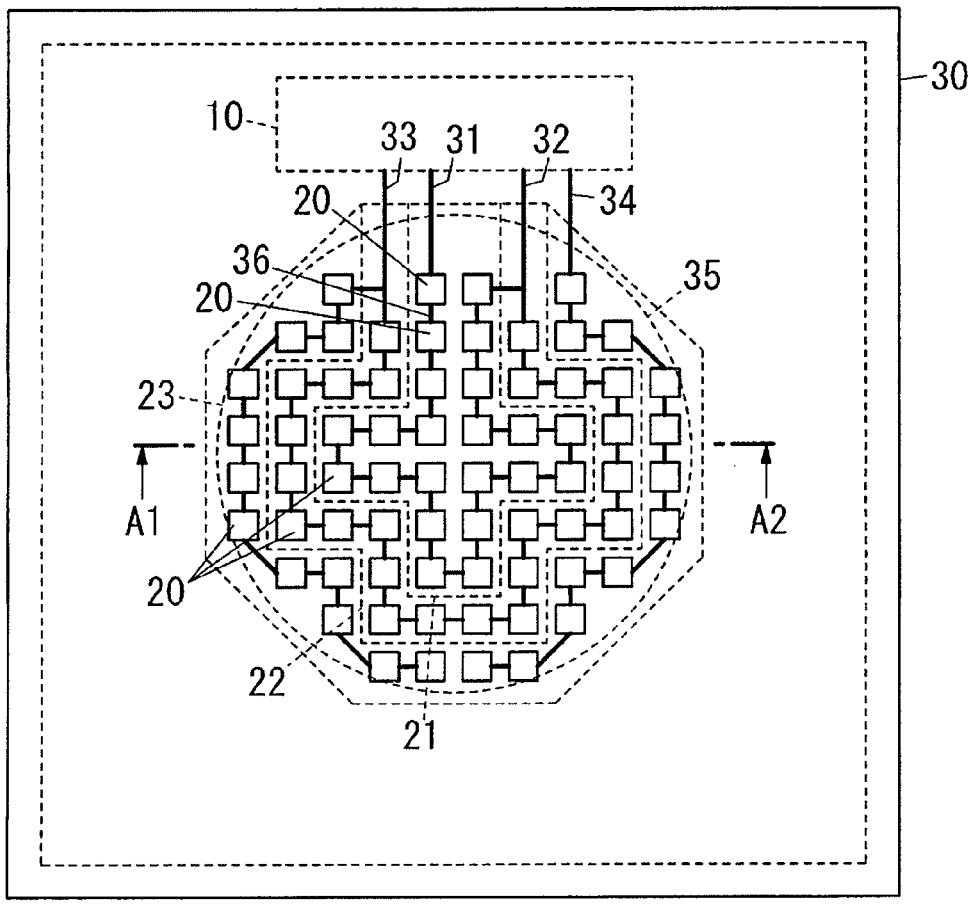
FIG. 2 is a plan view of a substrate which the lighting device in embodiment 1 includes.
Figure 7:
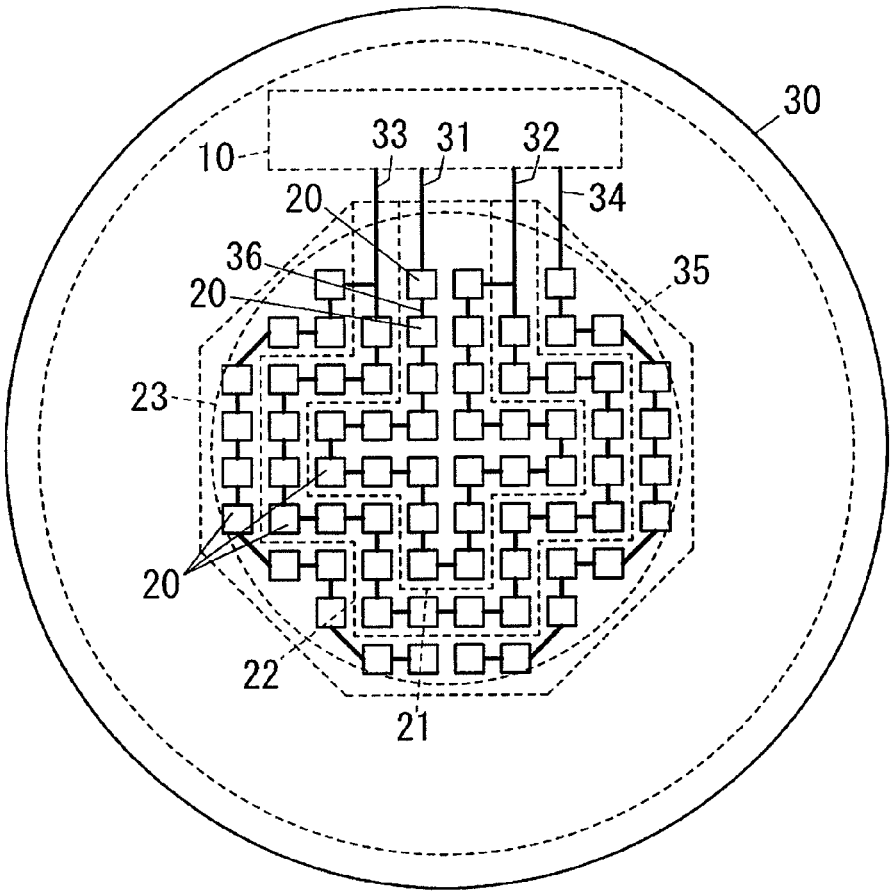
FIG. 7 is a plan view showing another form of the substrate which the lighting device in embodiment 1 includes.

In a form of FIG. 2, the substrate 30 is in the shape of a square in planar view, but is not limited thereto. As shown in FIG. 7, a substrate 30 is in the shape of a circle in planar view.

Figure 8:
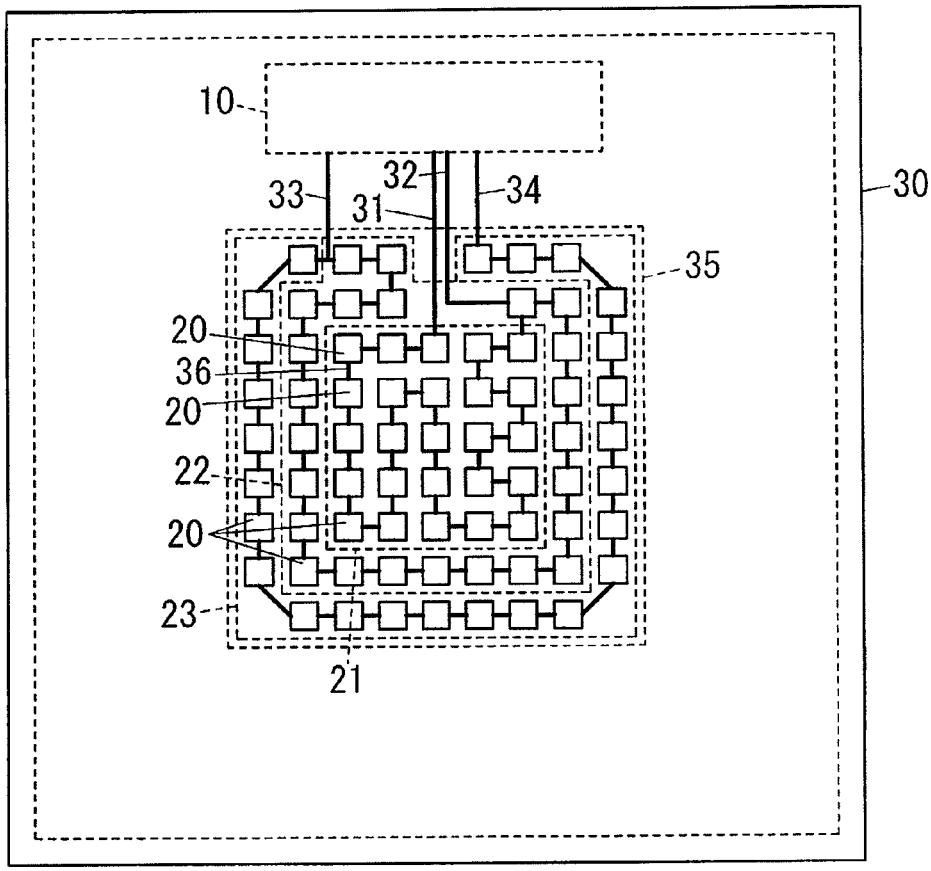
FIG. 8 is a plan view showing still another form of the substrate which the lighting device in embodiment 1 includes.

In the form of FIG. 2, the substrate 30 in the shape of the square is provided with the mounting region 35 in the shape of the circle, but as shown in FIG. 8, a substrate 30 may be provided with a mounting region 35 in the shape of a square.

In FIG. 8, a plurality of light-emitting diodes 20 are mounted on the mounting region 35 at regular intervals lengthwise and crosswise (in vertical and horizontal directions in FIG. 8). The substrate 30 is provided with conductive parts 36 for electrically connecting between each neighboring light-emitting diodes 20 so as to electrically connect the plurality of light-emitting diodes 20 along a single line.

The plurality of light-emitting diodes 20 is divided into a plurality (three in an example of FIG. 8) of light-emitting device arrays 21, 22 and 23. Light-emitting diodes 20 constituting the light-emitting device array 21 are arranged around a center of the mounting region 35 at regular intervals lengthwise and crosswise. Light-emitting diodes 20 constituting the light-emitting device array 22 are arranged outside the light-emitting diodes 20 constituting the light-emitting device array 21 so as to surround the light-emitting diodes 20 constituting the light-emitting device array 21. Light-emitting diodes 20 constituting the light-emitting device array 23 are arranged outside the light-emitting diodes 20 constituting the light-emitting device array 22 so as to surround the light-emitting diodes 20 constituting the light-emitting device array 22.

A control circuit 17 is configured to individually turn on/off a plurality of switch devices 13, 14 and 15 based on a value of a pulsating voltage V1 measured through a voltage meter circuit 16. During a time period that the value of the pulsating voltage V1 increases, the control circuit 17 performs ON/OFF control of the plurality of switch devices 13, 14 and 15 so as to increase the number of light-emitting diodes 20, which are lit, in accordance with the value of the pulsating voltage V1. During a time period that the value of the pulsating voltage V1 decreases, the control circuit 17 performs ON/OFF control of the plurality of switch devices 13, 14 and 15 so as to decrease the number of light-emitting diodes 20, which are lit, in accordance with the value of the pulsating voltage V1.

During the time period that the value of the pulsating voltage V1 increases, the control circuit 17 first lights the light-emitting device array 21 at an innermost position in the mounting region 35, then lights the light-emitting device array 22 outside the light-emitting device array 21, and finally lights the light-emitting device array 23 outside the light-emitting device array 22. During the time period that the value of the pulsating voltage V1 decreases, the control circuit 17 first extinguishes the light-emitting device array 23 at the outermost position in the mounting region 35, then extinguishes the light-emitting device array 22 inside the light-emitting device array 23, and finally extinguishes the light-emitting device array 21 inside the light-emitting device array 22. An operation, in which a range of light-emitting diodes 20 which are lit spreads from an inner side to an outer side in the mounting region 35 and then narrows from the outer side to the inner side in the mounting region 35, is repeated cyclically. Deviation of a light output from the mounting region 35 can be prevented and unevenness of the light output can be reduced.

As explained above, the lighting device 1 in the embodiment includes the rectifier circuit 11 (the rectifier), the plurality of light-emitting diodes 20 (semiconductor light-emitting devices), the substrate 30 and the control circuit 17 (the controller). The rectifier circuit 11 is configured to rectify the AC voltage from the AC power supply 50 to produce the pulsating voltage V1. The plurality of light-emitting diodes 20 is electrically connected in series between the first and second output terminals of the rectifier circuit 11. The plurality of light-emitting diodes 20 is mounted on an identical surface of the substrate 30. The control circuit 17 is configured to adjust the number of light-emitting diodes 20 that a current flows from the rectifier circuit 11 through so that the number of light-emitting diodes 20, which are lit, of the plurality of light-emitting diodes 20 increases according to the value of the pulsating voltage V1 during the time period that the value of the pulsating voltage V1 increases. The control circuit 17 is also configured to adjust the number of light-emitting diodes 20 that a current flows from the rectifier circuit 11 through so that the number of light-emitting diodes 20, which are lit, of the plurality of light-emitting diodes 20 decreases according to the value of the pulsating voltage V1 during the time period that the value of the pulsating voltage V1 decreases. Light-emitting diodes 20, which start to emit light by a higher voltage value, of the plurality of light-emitting diodes 20 are disposed at a position nearer to an outside of the mounting region 35 of the substrate 30 than light-emitting diodes 20, which start to emit light by a lower voltage value, of the plurality of light-emitting diodes 20. The mounting region 35 is a region of the substrate 30, on which the plurality of light-emitting diodes 20 is mounted. In other words, a light-emitting device array, which starts to emit light by a higher voltage value, of the plurality of light-emitting device arrays 21, 22 and 23 is disposed at a position nearer to an outside of the mounting region 35 than a light-emitting device array, which starts to emit light by a lower voltage value, of the plurality of light-emitting device arrays 21, 22 and 23.

During the time period that the value of the pulsating voltage V1 increases, the light-emitting diodes 20 at the innermost position in the mounting region 35 are first lit, and then light-emitting diodes 20 at a position nearer to an outside of the mounting region 35 are lit in turns. During the time period that the value of the pulsating voltage V1 decreases, the light-emitting diodes 20 at the outermost position in the mounting region 35 are first extinguished, and then light-emitting diodes 20 at a position nearer to a center of the mounting region 35 are lit in turns. That is, an operation, in which a range of light-emitting diodes 20 which are lit spreads from an inner side to an outer side in the mounting region 35 and then narrows from the outer side to the inner side in the mounting region 35, is repeated cyclically. Deviation of a light output from the mounting region 35 can be prevented and unevenness of the light output can be reduced. The light-emitting diodes 20 arranged at the innermost position in the mounting region 35 is lit for the longest time within one cycle of the pulsating voltage V1, and accordingly quantity of light around a center of the mounting region 35 can be increased. Therefore, light control can be made easy in a case where the lighting device 1 is embedded into a light fixture configured to give light to a specified object like a spotlight.

In the lighting device 1 of the embodiment, it is preferable that the mounting region 35 be a region in the shape of a rectangle. In this case, an operation, in which a range of light-emitting diodes 20 which are lit spreads from an inner side to an outer side in the mounting region 35 in the shape of the rectangle and then narrows from the outer side to the inner side in the mounting region 35, can be repeated cyclically.

In the lighting device 1 of the embodiment, it is preferable that the mounting region 35 be a region in the shape of a circle. In this case, an operation, in which a range of light-emitting diodes 20 which are lit spreads from an inner side to an outer side in the mounting region 35 in the shape of the circle and then narrows from the outer side to the inner side in the mounting region 35, can be repeated cyclically.

In the lighting device 1 of the embodiment, the substrate 30 may be provided with the mounting region 35 of the plurality of light-emitting diodes 20 that is disposed at a center of the surface on which the plurality of light-emitting diodes 20 is mounted, as shown in FIGS. 2, 7 and 8.

If being lit, light-emitting diodes 20 generate heat. Accordingly, a heat radiation member for dissipating heat generated from the light-emitting diodes 20 may be attached to the substrate 30. If the mounting region 35 for the plurality of light-emitting diodes 20 is provided at a center of the substrate 30, a structure for attaching the heat radiation member to the substrate 30 can be provided by holding outer edges of the substrate 30 between the heat radiation member and a fixture body housing the lighting device 1. If the substrate 30 is pressed at the outer edges thereof, it is possible to reduce dispersion in distance between the mounting region 35 provided at the center of the substrate 30 and the outer edges of the substrate 30 pressed by the heat radiation member. Uniform forces can be added to the substrate 30 by pressing the outer edges of the substrate 30 by the heat radiation member in a case where a warp or the like occurs in the substrate 30 by the heat generated from the light-emitting diodes 20. As a result, mechanical stress on the substrate 30 can be reduced.

(Embodiment 2)

A lighting device in accordance with an embodiment 2 of the invention is explained with reference to FIGS. 9 to 12.

Figure 9:
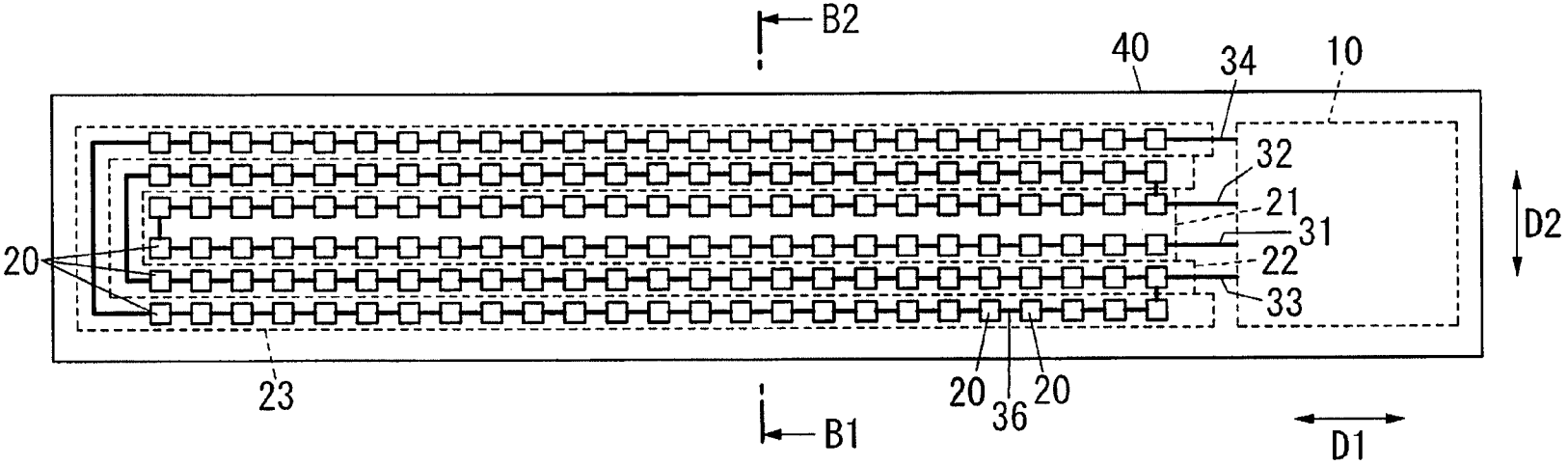
FIG. 9 is a plan view of a substrate which a lighting device in embodiment 2 includes.

As shown in FIG. 9, a lighting device 1 in the embodiment includes a substrate 40 shaped like a rectangular board that extends in a first direction D1. A plurality of light-emitting diodes 20 is mounted on the substrate 40 so that a plurality of light-emitting device arrays 21, 22 and 23, each of which includes two or more light-emitting diodes 20 arranged in the first direction D1, is arranged in a second direction D2 perpendicular to the first direction D1, and so that each of the plurality of light-emitting device arrays 21, 22 and 23 is in parallel with the first direction D1. Note that identical constituent elements to those of the lighting device 1 in embodiment 1 except for a shape of the substrate 40 and arrangement of the plurality of light-emitting diodes 20 mounted on the substrate 40 have been allocated identical reference numerals, and description thereof has been omitted as appropriate.

In the lighting device 1 of the embodiment, the plurality of light-emitting diodes 20 is mounted on one surface of the substrate 40 as shown in FIG. 9. The plurality of light-emitting diodes 20 is electrically connected in series, and divided into a plurality (e.g., three in a form of FIG. 9) of light-emitting device arrays 21, 22 and 23. In the embodiment, each of the plurality of light-emitting device arrays 21, 22 and 23 is formed of a series circuit of light-emitting diodes 20.

The plurality of light-emitting diodes 20 is mounted on the substrate 40 so that the plurality of light-emitting device arrays 21, 22 and 23, each of which includes two or more light-emitting diodes 20 arranged in the first direction D1 of the substrate 40, is arranged in the second direction D2 of the substrate 40, and so that each of the plurality of light-emitting device arrays 21, 22 and 23 is in parallel with the first direction D1. In an example of FIG. 9, the plurality of light-emitting diodes 20 is mounted on the substrate 40 so that each of the plurality of light-emitting device arrays 21, 22 and 23 is bent in the middle thereof, and so that the plurality of light-emitting diodes 20 are arranged in rows (e.g., six rows in the form of FIG. 9). The plurality of light-emitting diodes 20 is electrically connected in series via conductive parts 36 formed of conductive metal films formed on the surface of the substrate 40.

The plurality of light-emitting diodes 20 are mounted so as to be arranged along a single line corresponding to three U-shapes which are different in size. The light-emitting device array 21 is formed of two rows of light-emitting diodes 20 mounted along an innermost U-shape of the three U-shapes. The light-emitting device array 22 is formed of two rows of light-emitting diodes 20 mounted along a middle U-shape of the three U-shapes. The light-emitting device array 23 is formed of two rows of light-emitting diodes 20 mounted along an outermost U-shape of the three U-shapes. Thus, since the plurality of light-emitting diodes 20 is arranged along the single line corresponding to the three U-shapes, it is possible to electrically connect among the plurality of light-emitting diodes 20 via the conductive parts 36 formed on the surface of the substrate 40 without complicating wiring for the plurality of light-emitting diodes 20.

A first end of a circuit formed of the plurality of light-emitting diodes 20 in series (an end of the light-emitting device array 21 (a light-emitting diode 20 on a lower right end in FIG. 9)) is electrically connected to an output terminal of a constant current circuit 12 via a conductive part 31. A second end of the circuit formed of the plurality of light-emitting diodes 20 in series (an end of the light-emitting device array 23 (a light-emitting diode 20 on an upper right end in FIG. 9)) is electrically connected to a first electrode (a drain electrode) of a switch device 15 via a conductive part 34. A light-emitting diode 20, electrically connected to the light-emitting device array 22, of light-emitting diodes 20 constituting the light-emitting device array 21 is electrically connected to a first electrode (a drain electrode) of a switch device 13 via a conductive part 32. A light-emitting diode 20, electrically connected to the light-emitting device array 23, of light-emitting diodes 20 constituting the light-emitting device array 22 is electrically connected to a first electrode (a drain electrode) of a switch device 14 via a conductive part 33.

A lighting operation of light-emitting diodes 20 lit by a lighting circuit 10 is explained with reference to FIGS. 3 and 10 to 12.

A control circuit 17 sets each of the plurality of switch devices 13, 14 and 15 to an OFF state during a time period that a pulsating voltage V1 is below a threshold voltage L1 (a time period T1 from a time point t0 to a time point t1, and a time period T7 from a time point t6 to a time point t7). In this case, all the light-emitting diodes 20 of the plurality of light-emitting device arrays 21, 22 and 23 are extinguished because no current flows through all the light-emitting diodes 20 of the plurality of light-emitting device arrays 21, 22 and 23.

Figure 10:
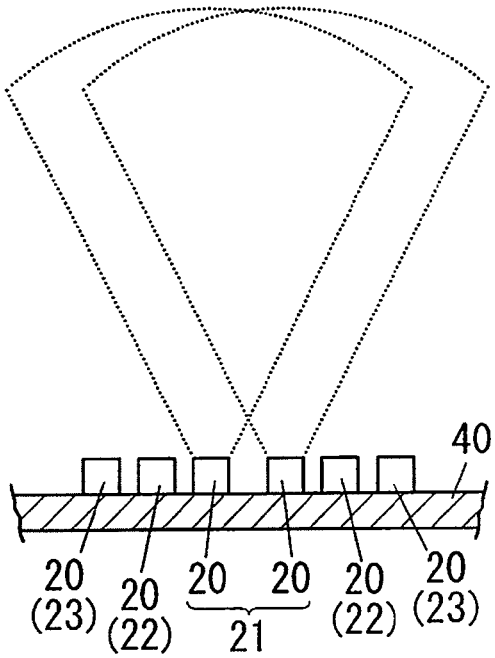
FIG. 10 is a sectional view taken along a B1-B2 line in FIG. 9 and shows a lighting state by the lighting device in embodiment 2.

The control circuit 17 sets the switch device 13 to an ON state and sets each of the switch devices 14 and 15 to an OFF state during a time period that the pulsating voltage V1 is the threshold voltage L1 or more and below a threshold voltage L2 (a time period T2 from the time point t1 to a time point t2 and a time period T6 from a time point t5 to the time point t6). In this case, a current flows through only all the light-emitting diodes 20 of the light-emitting device array 21, and no current flows through all the light-emitting diodes 20 of the light-emitting device arrays 22 and 23. This lighting state by the plurality of light-emitting device arrays 21, 22 and 23 is shown in FIG. 10 which is a sectional view taken along a B1-B2 line in FIG. 9, and in which dotted lines illustrate respective light emitted from the light-emitting diodes 20 of the light-emitting device array 21. During the time periods T2 and T6, all the light-emitting diodes 20 of the light-emitting device array 21 arranged at center two rows in the second direction D2 of the substrate 40 are lit, and all the light-emitting diodes 20 of the light-emitting device arrays 22 and 23 arranged outside the light-emitting device array 21 are extinguished.

Figure 11:
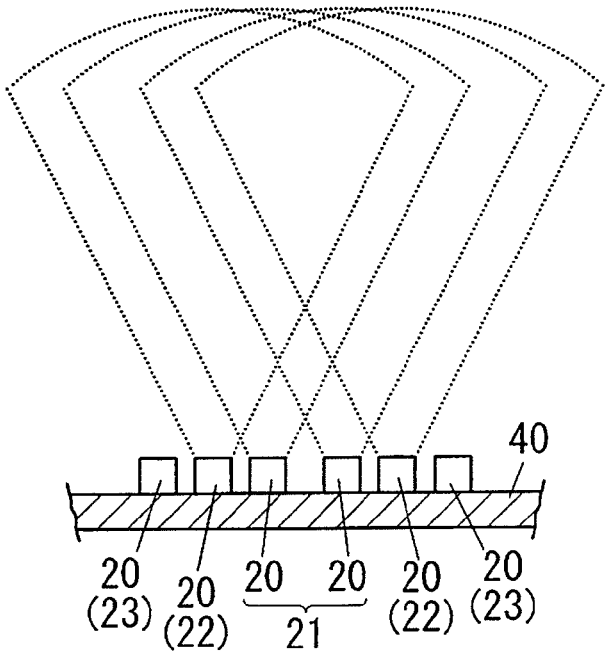
FIG. 11 is a sectional view taken along a B1-B2 line in FIG. 9 and shows a lighting state by the lighting device in embodiment 2.

The control circuit 17 sets the switch device 14 to an ON state and sets each of the switch devices 13 and 15 to an OFF state during a time period that the pulsating voltage V1 is the threshold voltage L2 or more and below a threshold voltage L3 (a time period T3 from the time point t2 to a time point t3 and a time period T5 from a time point t4 to the time point t5). In this case, a current flows through all the light-emitting diodes 20 of the light-emitting device arrays 21 and 22, and no current flows through all the light-emitting diodes 20 of the light-emitting device array 23. This lighting state by the plurality of light-emitting device arrays 21, 22 and 23 is shown in FIG. 11 which is the sectional view taken along the B1-B2 line in FIG. 9, and in which dotted lines illustrate respective light emitted from the light-emitting diodes 20 of the light-emitting device arrays 21 and 22. During the time periods T3 and T5, all the light-emitting diodes 20 of the light-emitting device arrays 21 and 22 arranged at four rows except for outermost two rows in the second direction D2 of the substrate 40 are lit, and all the light-emitting diodes 20 of the light-emitting device array 23 arranged at the outermost two rows therein are extinguished.

Figure 12:
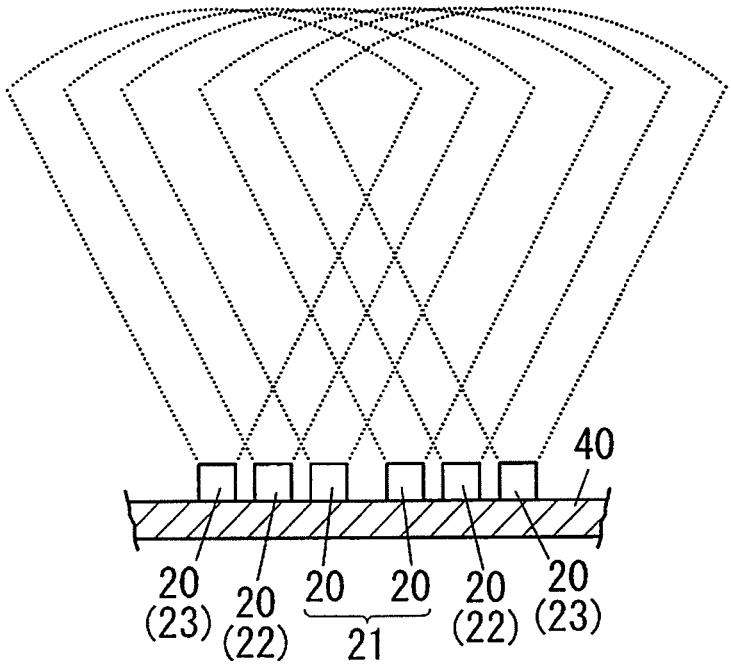
FIG. 12 is a sectional view taken along a B1-B2 line in FIG. 9 and shows a lighting state by the lighting device in embodiment 2.

The control circuit 17 sets the switch device 15 to an ON state and sets each of the switch devices 13 and 14 to an OFF state during a time period that the pulsating voltage V1 is the threshold voltage L3 or more (a time period T4 from the time point t3 to the time point t4). In this case, a current flows through all the light-emitting diodes 20 of the plurality of light-emitting device arrays 21, 22 and 23, and all the light-emitting diodes 20 of the plurality of light-emitting device arrays 21, 22 and 23 are lit. This lighting state by the plurality of light-emitting device arrays 21, 22 and 23 is shown in FIG. 12 which is the sectional view taken along the B1-B2 line in FIG. 9, and in which dotted lines illustrate respective light emitted from the plurality of light-emitting diodes 20 of the light-emitting device arrays 21, 22 and 23. During the time period T4, all the light-emitting diodes 20 of the plurality of light-emitting device arrays 21, 22 and 23 mounted on the substrate 40 are lit.

As stated above, the control circuit 17 performs ON/OFF control of the plurality of switch devices 13, 14 and 15 to increase or decrease the number of light-emitting diodes 20, which are lit, in accordance with the value of the pulsating voltage V1.

In the embodiment, during a time period that the value of the pulsating voltage V1 increases (a half-cycle of the pulsating voltage V1), the control circuit 17 performs ON/OFF control of the plurality of switch devices 13, 14 and 15 so as to increase the number of light-emitting diodes 20, which are lit, in accordance with the value of the pulsating voltage V1. Thus, the lighting device 1 switches, in turns, the plurality of switch devices 13, 14 and 15 from a state of all the plurality of light-emitting diodes 20 being extinguished, to a state of FIG. 10 in which only the light-emitting device array 21 is lit, a state of FIG. 11 in which the light-emitting device arrays 21 and 22 are lit, and a state of FIG. 12 in which all the plurality of light-emitting diodes 20 is lit.

During a time period that the value of the pulsating voltage V1 decreases (another half-cycle of the pulsating voltage V1), the control circuit 17 performs ON/OFF control of the plurality of switch devices 13, 14 and 15 so as to decrease the number of light-emitting diodes 20, which are lit, in accordance with the value of the pulsating voltage V1. Thus, the lighting device 1 switches, in turns, the switch devices 13, 14 and 15 from the state of FIG. 12 in which all the plurality of light-emitting diodes 20 are lit, to a state of FIG. 11 in which the light-emitting device arrays 21 and 22 are lit, a state of FIG. 10 in which only the light-emitting device array 21 is lit, and then a state of all the plurality of light-emitting diodes 20 being extinguished.

During the time period that the value of the pulsating voltage V1 increases, the light-emitting device array 21 at the innermost position in the second direction D2 of the substrate 40 is first lit, the light-emitting device array 22 outside the light-emitting device array 21 is then lit, and the light-emitting device array 23 outside the light-emitting device array 22 is finally lit. During the time period that the value of the pulsating voltage V1 decreases, the light-emitting device array 23 at the outermost position in the second direction D2 of the substrate 40 is first extinguished, the light-emitting device array 22 inside the light-emitting device array 23 is then extinguished, and the light-emitting device array 21 inside the light-emitting device array 22 is finally extinguished. An operation, in which a range of light-emitting diodes 20 which is lit spreads from an inner side to an outer side in the second direction D2 of the substrate 40 and then narrows from the outer side to the inner side in the second direction D2, is repeated cyclically. Deviation of a light output from the mounting region of the plurality of light-emitting diodes 20 can be prevented and unevenness of the light output can be reduced.

As explained above, the lighting device 1 in the embodiment includes the rectifier circuit 11 (a rectifier), the plurality of light-emitting diodes 20 (semiconductor light-emitting devices), the substrate 40 and the control circuit 17 (the controller). The rectifier circuit 11 is configured to rectify an AC voltage from the AC power supply 50 to produce the pulsating voltage V1. The plurality of light-emitting diodes 20 is electrically connected in series between the first and second output terminals of the rectifier circuit 11. The plurality of light-emitting diodes 20 is mounted on an identical surface of the substrate 40 in the shape of rectangular board. The control circuit 17 is configured to adjust the number of semiconductor light-emitting devices 20 that a current flows from the rectifier circuit 11 through so that the number of light-emitting diodes 20, which are lit, of the plurality of light-emitting diodes 20 increases according to the value of the pulsating voltage V1 during the time period that the value of the pulsating voltage V1 increases. The control circuit 17 is also configured to adjust the number of light-emitting diodes 20 that a current flows from the rectifier circuit 11 through so that the number of light-emitting diodes 20, which are lit, of the plurality of light-emitting diodes 20 decreases according to the value of the pulsating voltage V1 during the time period that the value of the pulsating voltage V1 decreases. The substrate 40 is shaped like a rectangular board that extends in the first direction D1. The plurality of light-emitting diodes 20 is mounted on the substrate 40 so that the plurality of light-emitting device arrays 21, 22 and 23, each of which includes two or more light-emitting diodes 20 arranged in the first direction D1 of the substrate 40, is arranged in the second direction D2 of the substrate 40, and so that each of the plurality of light-emitting device arrays 21, 22 and 23 is in parallel with the first direction D1. A light-emitting diode array, which starts to emit light by a higher voltage value, of the plurality of light-emitting diode array 21, 22 and 23 is disposed at a position nearer to an outside of the mounting region in the second direction D2 than a light-emitting diode array, which starts to emit light by a lower voltage value, of the plurality of light-emitting device arrays 21, 22 and 23.

During the time period that the value of the pulsating voltage V1 increases, the light-emitting diodes 20 at the innermost rows in the second direction D2 of the substrate 40 are first lit, and light-emitting diodes 20 at rows nearer to an outside of the mounting region in the second direction D2 are lit in turns. During the time period that the value of the pulsating voltage V1 decreases, the light-emitting diodes 20 at the outermost rows in the second direction D2 of the substrate 40 are first extinguished, and light-emitting diodes 20 at rows nearer to a center of the mounting region in the second direction D2 are extinguished in turns. That is, an operation, in which a range of light-emitting diodes 20 which are lit spreads from an inner side to an outer side in the second direction D2 of the substrate 40 and then narrows from the outer side to the inner side in the second direction D2, is repeated cyclically. Deviation of a light output from the mounting region of light-emitting diodes 20 can be prevented and unevenness of the light output can be reduced.

(Embodiment 3)

A light fixture with a lighting device 1 explained in an embodiment 1 or 2 is explained with reference to FIGS. 13 and 14.

Figure 13:
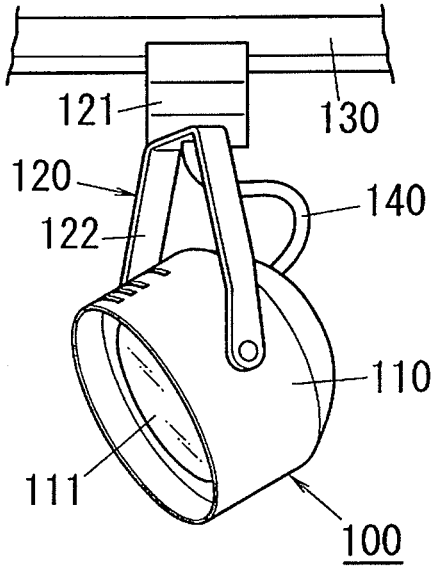
FIG. 13 is an external perspective view of a light fixture in embodiment 3.

FIG. 13 is an external perspective view of a ceiling hanging light fixture 100. The light fixture 100 includes a fixture body 110 and a bracket 120.

The bracket 120 includes a base 121 that is movably attached to a long rail member 130 fixed to a ceiling, and a forked arm 122 that is attached to a lower face of the base 121. Conductive members for power supply are attached to the rail member 130 along a length direction of the rail member 130. The base 121 is provided with current collectors that are electrically connected to the conductive members. The current collectors of the base 121 are electrically connected with one ends of electric wires of the cable 140.

For example, the fixture body 110 is made of metal material and shaped like a cylinder. Intermediate part of the arm 122 is attached to the fixture body 110 so as to be free to rotate. A lighting device 1 explained in embodiment 1 or 2 is housed in the fixture body 110. A rectifier circuit 11 of the lighting device 1 is electrically connected to the current collectors of the base 121 via the cable 140. Electric power is supplied to the lighting device 1 from the rail member 130 via the cable 140.

A translucent lens 111 is provided at an end face of the fixture body 110 shaped like the cylinder. Respective light from light-emitting diodes 20 is emitted outside through the lens 111.

A light fixture with a lighting device 1 explained in an embodiment 1 or 2 is not limited to the ceiling hanging light fixture 100. As shown in FIG. 14, such a lighting device 1 may be used for a stand light fixture 200 (a floodlight). The light fixture 200 includes a fixture body 210 shaped like a box, and a stand 220 that supports the fixture body 210.

A lighting device 1 explained in an embodiment 1 or 2 is housed in the fixture body 210. A translucent lens 211 is provided at a surface of the fixture body 210. Respective light from light-emitting diodes 20 is emitted outside through the lens 211.

As explained above, the light fixture in the embodiment includes a lighting device 1 explained in an embodiment 1 or 2, and a fixture body 110 or 210 holding the lighting device 1. By using a lighting device 1 explained in an embodiment 1 or 2, it is possible to provide a light fixture capable of reducing unevenness of a light output of light-emitting diodes 20 without complicating wiring (conductive parts 36) for electrically connecting among a plurality of light-emitting diodes 20 mounted on a substrate.

Figure 14:
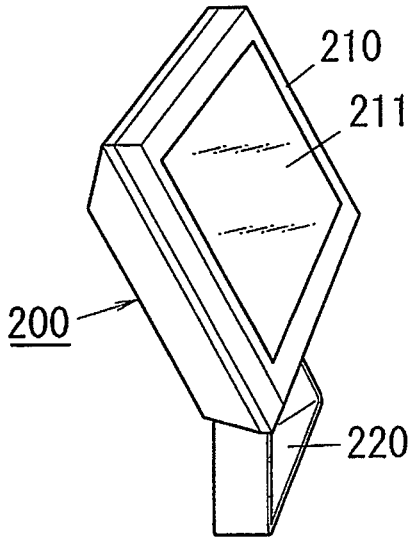
FIG. 14 is an external perspective view showing another form of the light fixture in embodiment 3.

A light fixture with a lighting device 1 explained in an embodiment 1 or 2 is not limited to the ceiling hanging light fixture 100 shown in FIG. 13 or the stand light fixture 100 shown in FIG. 14, but may be a light fixture such as a downlight or a spotlight.

In the abovementioned embodiments, a lighting device 1 for lighting a plurality of light-emitting diodes 20 is exemplified. However, a plurality of semiconductor light-emitting devices to be lit by the lighting device 1 is not limited to the plurality of light-emitting diodes 20, but may be electroluminescence devices.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device, comprising:

a rectifier configured to rectify an AC voltage to produce a pulsating voltage;

a substrate;

a plurality of semiconductor light-emitting devices that is mounted on an identical surface of the substrate and electrically connected in series between first and second output terminals of the rectifier; and a controller configured to adjust a number of semiconductor light-emitting devices that a current flows from the rectifier through so that:

a number of semiconductor light-emitting devices, which are lit, of the plurality of semiconductor light-emitting devices increases according to a value of the pulsating voltage during a time period that the value of the pulsating voltage increases; and the number of semiconductor light-emitting devices, which are lit, of the plurality of semiconductor light-emitting devices decreases according to the value of the pulsating voltage during a time period that the value of the pulsating voltage decreases, wherein semiconductor light-emitting devices, which start to emit light by a higher voltage value, of the plurality of semiconductor light-emitting devices are disposed at a position nearer to an outside of a mounting region of the substrate than semiconductor light-emitting devices, which start to emit light by a lower voltage value, of the plurality of semiconductor light-emitting devices, the mounting region being a region of the substrate, on which the plurality of semiconductor light-emitting devices is mounted, the substrate is shaped like a rectangular board that extends in a first direction, the plurality of semiconductor light-emitting devices are mounted on the substrate so that a plurality of light-emitting device arrays, each of which comprises two or more semiconductor light-emitting devices arranged in the first direction, are arranged in a second direction perpendicular to the first direction, and so that each of the plurality of light-emitting device arrays is in parallel with the first direction, and a light-emitting device array, which starts to emit light by a higher voltage value, of the plurality of light-emitting device arrays is disposed at a position nearer to an outside of the mounting region in the second direction than a light-emitting device array, which starts to emit light by a lower voltage value, of the plurality of light-emitting device arrays.

2. The lighting device of claim 1, wherein the plurality of semiconductor light-emitting devices is divided into a plurality of light-emitting device arrays, each of the plurality of light-emitting device arrays comprises first and second electrodes electrically connected to sides of the first and second output terminals of the rectifier, respectively, and the lighting device comprises a plurality of switch devices electrically connected between the second electrodes of the plurality of light-emitting device arrays and the second output terminal of the rectifier, respectively.

3. The lighting device of claim 1, further comprising a voltage measuring circuit configured to measure the value of the pulsating voltage to supply the measured value to the controller.

4. The lighting device of claim 1, further comprising a constant current circuit intervening between the first output terminal of the rectifier and the plurality of light-emitting device arrays.

5. A light fixture, comprising:

a lighting device of claim 1; and a fixture body that holds the lighting device.

* * * * *